US006131592A

United States Patent [19]

Panizza

[11] Patent Number: 6,131,592

[45] Date of Patent: Oct. 17, 2000

[54] SHOCK-ABSORBING WALKING STICK

[75] Inventor: Paolo Panizza, Bassano Del Grappa, Italy

[73] Assignee: Gabel S.r.l., Tezze Sul Brenta, Italy

[21] Appl. No.: 08/899,137

[22] Filed: Jul. 23, 1997

[30] Foreign Application Priority Data

Jul. 26, 1996 [IT] Italy ..... PD960072 U

[51] Int. Cl.[7] ..... A45B 9/00

[52] U.S. Cl. ..... 135/66; 403/220; 403/340

[58] Field of Search ..... 135/66, 68, 75, 135/76, 77, 82, 83, 84, 86; 403/225, 228, 372, 300, 305, 220, 340

[56] References Cited

U.S. PATENT DOCUMENTS

| | | | |
|---|---|---|---|
| 788,541 | 5/1905 | Kunkel | 135/82 |
| 1,909,337 | 5/1933 | Crosbie | 135/83 |

FOREIGN PATENT DOCUMENTS

| | | | |
|---|---|---|---|
| 2 617 023 | 12/1988 | France . | |
| 195 03 565 | 8/1996 | Germany . | |
| 196 27 235 | 3/1997 | Germany . | |
| 124691 | 4/1919 | United Kingdom | 135/82 |

OTHER PUBLICATIONS

Patent Abstracts of Japan vol. 013, No. 283 (C–612), Jun. 28, 1989 & JP 01 076856 A (Kinugawa Rubber), Mar. 22, 1989 * abstract *.

*Primary Examiner*—Michael Safavi
*Attorney, Agent, or Firm*—Guido Modiano; Albert Josif; Daniel O'Byrne

[57] ABSTRACT

A shock-absorbing walking stick includes a longitudinally elongated body having two separate coaxial sections. A first or lower section is connected to a second or upper section which has a handle attached thereto. A tubular connecting element is utilized to connect the first section to the second section. The tubular connecting element formed of two members each having a bifurcated tubular portion with a flange encircling the tubular portion. An elastic tubular element is inserted between the opposing flanges of the two members. This arrangement allowing for a cushioning effect permitting relative movement between the upper and lower sections.

6 Claims, 2 Drawing Sheets

SHOCK-ABSORBING WALKING STICK

BACKGROUND OF THE INVENTION

The present invention relates to a shock-absorbing walking stick.

It is known that the practice of trekking and the habit of walking as a refreshing and healthy factor in people of practically all ages are becoming increasingly widespread.

It is also known that walking is particularly facilitated and assisted by the use of walking sticks which in addition to providing partial support can aid the user in crossings which are particularly troublesome or for which an additional resting point, in addition to the feet which can be in unstable conditions, is particularly appreciable.

The walking stick is also particularly appreciated by elderly people, whom it allows to walk easily and in full safety in terms of stable balance.

Currently, in order to improve the ground contact of walking sticks and to cushion the shocks and any vibrations produced in them when they are rested on particularly hard ground, walking sticks have been manufactured which are shock-absorbing by means of one or more elastic elements inserted in the handle or in one of the segments of the stick.

The solution which entails the insertion of shock-absorbing elements in the stick or handle is not free from drawbacks, although it performs its required functions.

In particular, attention must be drawn to the drawback related to the internal bulk caused by the shock-absorbing elements located inside the tubes that constitute the shaft of the stick, which must accordingly be produced with size constraints which are imposed by said shock-absorbing elements.

Moreover, since the shock-absorbing elements are located inside the stick, it is absolutely impossible to detect their wear, if any, and it is particularly complicated to perform maintenance or replacement thereof if necessary.

It is also particularly difficult to compensate for any yielding of the shock-absorbing elements.

SUMMARY OF THE INVENTION

The aim of the present invention is to provide a shock-absorbing walking stick which solves the above-mentioned drawbacks of conventional sticks, particularly eliminating the size constraints imposed to the stick body.

Within the scope of this aim, an object of the present invention is to provide a walking stick in which any wear of the shock-absorbing elements is clearly visible, consequently simplifying their maintenance or replacement.

Another object of the present invention is to provide a walking stick in which any yielding of the shock-absorbing element or elements can be easily compensated.

Another object of the present invention is to provide a walking stick in which the shock-absorbing region is hermetic.

Another object of the present invention is to provide a walking stick which can be manufactured with competitive costs with respect to conventional sticks and for which appreciable aesthetic and styling results are optionally possible.

Another object of the present invention is to provide a walking stick which can be manufactured with conventional equipment.

This aim, these objects and others which will become apparent hereinafter are achieved by a shock-absorbing walking stick, characterized in that it comprises a longitudinally elongated body which comprises at least two separate coaxial sections: a first section for resting on the ground and a second section connected to a handle of the stick, said first and second sections being associated with respective facing external bases, between which at least one likewise external elastic element is interposed which is suitable to cushion the relative movement between said at least two sections.

BRIEF DESCRIPTION OF THE DRAWINGS

Further characteristics and advantages of the present invention will become apparent from the following detailed description of two embodiments thereof and of corresponding different embodiments, illustrated only by way of non-limitative example in the accompanying drawings, wherein.

DESCRIPTION OF THE PREFERRED EMBODIMENTS

Figure 1:
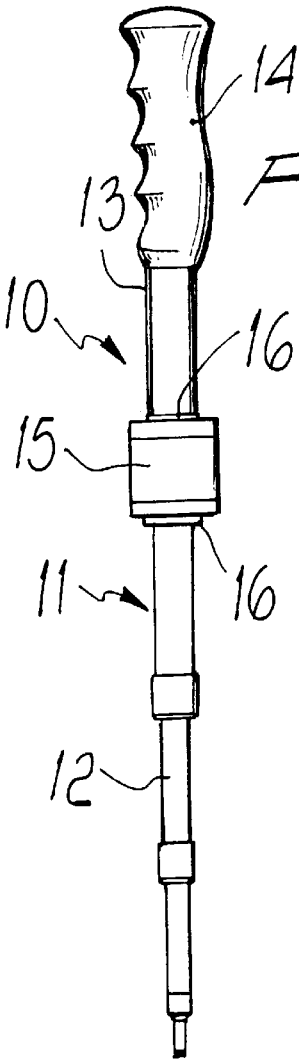
FIG. 1 is an elevation view of a stick according to the present invention in a first embodiment.
Figure 2:
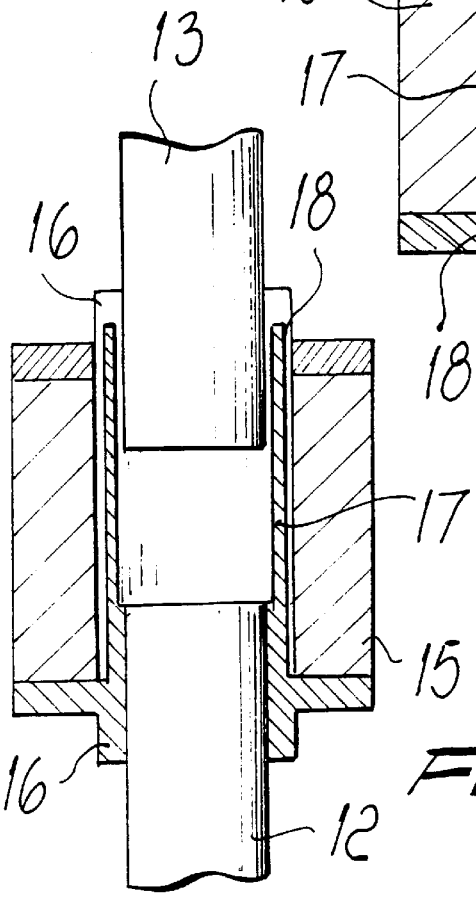
FIGS. 2 and 3 are partially sectional views of a detail of the stick of FIG. 1.
Figure 3:
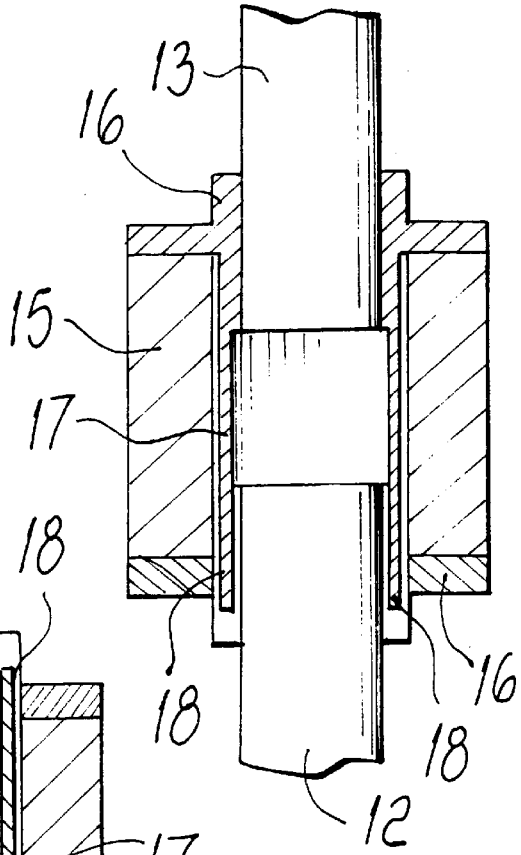

With particular reference to FIGS. 1 to 4, a shock-absorbing walking stick according to the invention is generally designated by the reference numeral 10.

The walking stick 10 comprises a longitudinally elongated body 11 which comprises at least two separate coaxial sections: a first section 12 for resting on the ground, which is telescopic in this case, and a second section 13, which is rigidly coupled to a handle designated by the reference numeral 14.

The first section 12 and the second section 13 are associated, as will become apparent hereinafter, with facing external bases thereof, between which a likewise external tubular elastic element 15 is interposed, said elastic element 15 being suitable to cushion the relative movement between the two sections 12 and 13.

The elastic tubular element 15 is preferably made of elastomeric material, but it can also be constituted by a metallic spring of the cylindrical helical type or by an equivalent device.

In this first embodiment, the first section 12 and the second section 13 have respective facing bases; a flanged tubular element 16, suitable to form a base for the elastic element 15, is fixed to each one of the ends of the first and second sections.

More specifically, each one of the tubular elements 16, conveniently and preferably made of plastics and rigidly coupled to the respective section, for example by interference fit, is arranged upon assembly, and in opposition with respect to the section with which it is associated, so as to form a fork 17 which is connected to a similar fork 17 which protrudes from the tubular element 16, which is arranged opposite upon assembly.

Moreover, each one of the tubular elements 16 is shaped so as to form, at the flange, three mutually opposite through openings 18 and so as to form, at the openings, longitudinal seats 19 for the sliding of the fork 17 of the tubular element 16 which is mutually opposite upon assembly.

Figure 4:
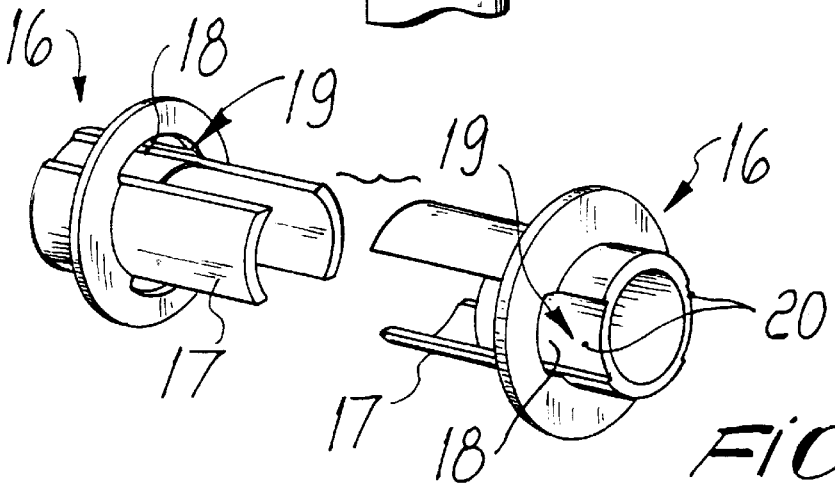
FIG. 4 is a perspective exploded view of another detail of the stick of FIG. 1.

With particular reference to FIG. 4, the sliding seats 19 are constituted by slots 20 formed in mutually opposite portions of the corresponding tubular element 16.

Figure 5:
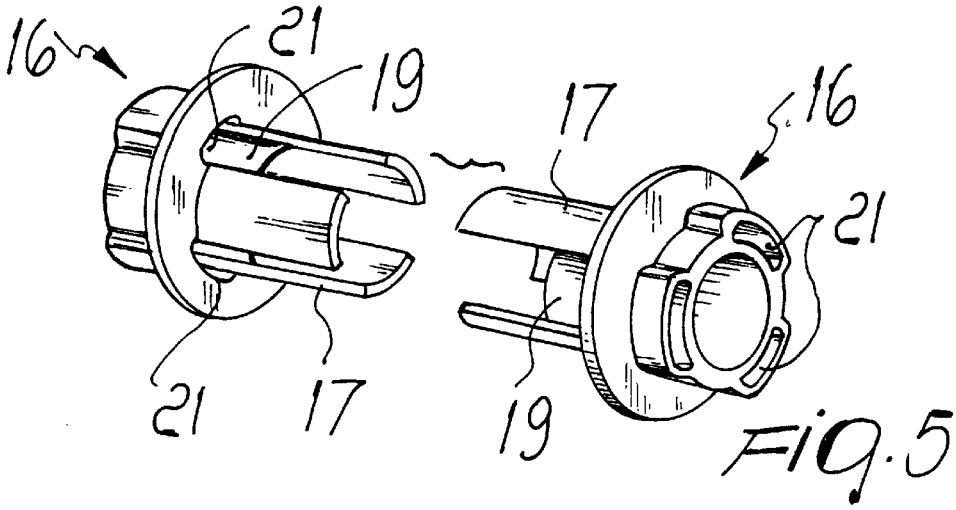
FIG. 5 is a perspective exploded view of a different embodiment of the detail of FIG. 4 of the stick of FIG. 1.

With particular reference to FIG. 5, in a different embodiment the sliding seats 19 are instead closed so as to form substantially three optionally blind ducts 21.

Figure 7:
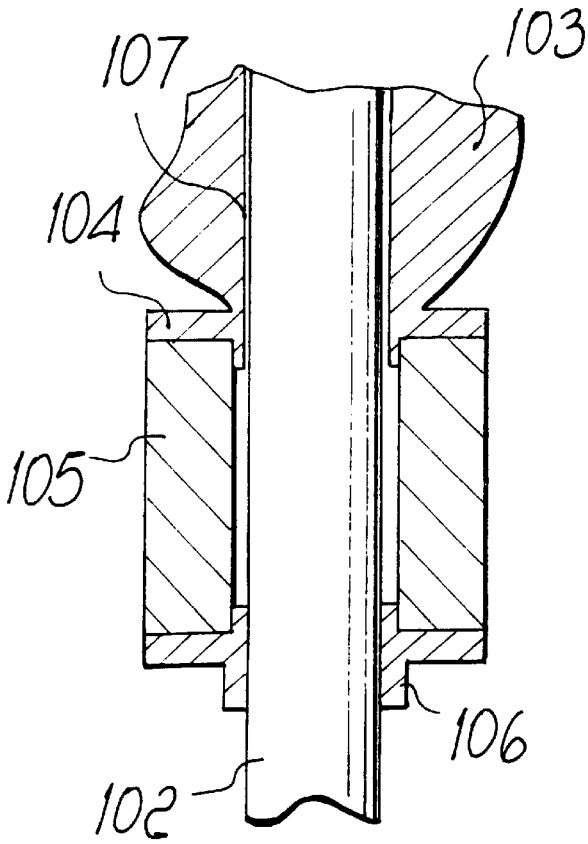
FIG. 7 is a partially sectional view of a detail of the stick of FIG. 6.
Figure 6:
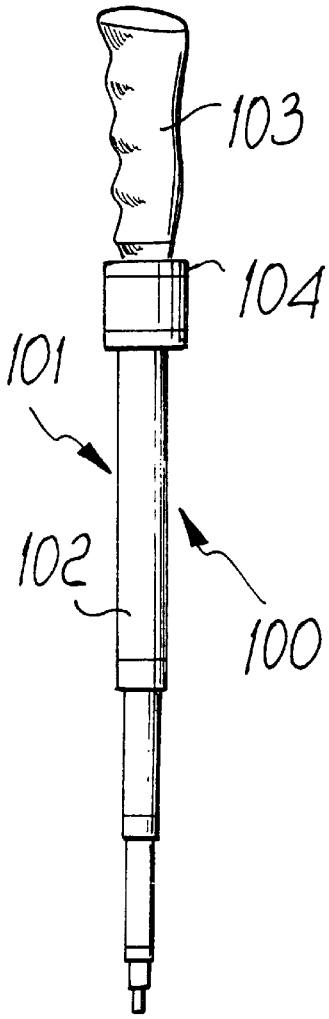
FIG. 6 is an elevation view of a stick according to the present invention, in a second embodiment.

With particular reference to FIGS. 6 and 7, a walking stick according to a second embodiment of the invention is generally designated by the reference numeral 100.

The stick 100 comprises a longitudinally elongated body 101 which comprises at least two separate coaxial sections: a first ground resting section, designated by the reference numeral 102, and a second section 103 which in this case substantially coincides with the handle.

A flange 104 extends monolithically, in this case, from the second section 103, is suitable to constitute a base for an elastic element 105 and is arranged opposite, upon assembly, with respect to a flanged tubular element 106 associated with the first section 102.

The first section 102 coaxially enters, in this case, an axial duct 107 formed in the second section 103.

In other embodiments, the elastic element can be formed monolithically with respect to one or both bases, for example by overmolding; it may also have a shape which forms a sectional profile which is not straight or a cross-section which is not rectangular.

In practice, it has been observed that the present invention has achieved the intended aim and objects.

In particular, it should be noted that the provision of the shock-absorbing action of the stick on the outside fully eliminates the problem of bulk inside the body of the stick, allowing freedom from size constraints in the manufacture of said stick.

It should also be noted that the arrangement of the shock-absorbing elements on the outside allows continuous viewing of their wear condition and furthermore allows to perform maintenance and replacement thereof simply and quickly.

It should also be noted that in the walking stick according to the invention it is particularly easy to compensate for any yielding of the shock-absorbing elements over time.

In monolithic embodiments, the shock-absorbing elements can be sealed very easily against water or moisture infiltrations.

The constructive simplicity of the stick according to the present invention should also be noted; it allows to achieve production costs which are competitive with respect to conventional sticks.

The structural flexibility of the stick according to the present invention should also be noted; it allows to provide a wide variety of models, starting from cheaper ones up to those having the most advanced technical, aesthetic and styling characteristics.

The present invention is susceptible of numerous modifications and variations, all of which are within the scope of the inventive concept; the details may furthermore be replaced with other technically equivalent elements.

The materials and the dimensions may be any according to requirements.

What is claimed is:

1. A shock-absorbing walking stick, comprising a longitudinally elongated body which comprises at least two separate coaxial and mutually interconnected sections, said at least two separate coaxial sections comprising a first section for resting on the ground and a second connected to a handle of the stick, said first and second sections having respective facing external bases between which at least one external elastic element is interposed which is suitable to cushion the relative movement between said first and second sections, said first and second sections have respective facing ends, a respective flanged tubular element being fixed to each one of said ends and supporting said at least one elastic element, each one of said tubular elements being elongated and arranged in opposition with respect to the section with which it is associated, so as to form a fork which is connected to a similar fork that protrudes from the tubular element which is mutually opposite.

2. A stick according to claim 1, wherein each one of said tubular elements is shaped so as to form, at the flange, one or more mutually opposite through openings and, at said openings, longitudinal sliding seats for the sliding of the fork of the tubular element which is mutually opposite.

3. A stick according to claim 2, wherein said sliding seats are constituted by mutually opposite slots formed on the sides of the corresponding tubular element.

4. A stick according to claim 2, wherein said sliding seats are closed so as to form one or more mutually opposite and blind ducts.

5. A stick according to claim 1, wherein said at least one elastic element has a cylindrical shape.

6. A shock-absorbing walking stick, comprising a longitudinally elongated body which comprises at least two separate coaxial and mutually interconnected sections, said at least two separate coaxial and mutually interconnected sections comprising a first section for resting on the ground and a second section connected to a handle of the stick, at least one external elastic element being interposed between said first and second sections which is suitable to cushion the relative movement between said first and second sections, wherein said second section substantially coincides with the handle, from which a flange protrudes monolithically which supports said elastic element and is arranged opposite with respect to a flanged tubular element connected with said first section, said first section entering coaxially an axial duct formed in said handle.

* * * * *